US008899134B2

(12) United States Patent
Kluhsman, Jr.

(10) Patent No.: US 8,899,134 B2
(45) Date of Patent: Dec. 2, 2014

(54) HIGH-EFFICIENCY WHEEL LUG NUT SOCKET FOR USE IN AUTOMOTIVE RACING PITS

(75) Inventor: Mel L. Kluhsman, Jr., Lockwood, MO (US)

(73) Assignee: Kluhsman Machine, Inc., Lockwood, MO (US)

( * ) Notice: Subject to any disclaimer, the term of this patent is extended or adjusted under 35 U.S.C. 154(b) by 286 days.

(21) Appl. No.: 13/598,228

(22) Filed: Aug. 29, 2012

(65) Prior Publication Data

US 2014/0060260 A1 Mar. 6, 2014

(51) Int. Cl.
*B25B 13/06* (2006.01)
*B25B 27/00* (2006.01)

(52) U.S. Cl.
CPC ..... *B25B 27/0035* (2013.01); *B25B 13/065* (2013.01)
USPC ..... 81/121.1; 81/124.6

(58) Field of Classification Search
CPC ..... B25B 13/02; B25B 13/06; B25B 13/065; B25B 23/0057; B25B 27/00; B60B 29/00
USPC ..... 81/119, 121.1, 124.1, 124.3, 124.6
See application file for complete search history.

(56) References Cited

U.S. PATENT DOCUMENTS

| | | | | |
|---|---|---|---|---|
| 4,581,957 | A * | 4/1986 | Dossier | 81/121.1 |
| 6,131,493 | A * | 10/2000 | Yamamoto et al. | 81/121.1 |
| 7,225,710 | B2 * | 6/2007 | Pacheco, Jr. | 81/460 |
| 7,568,872 | B2 * | 8/2009 | Schultz | 411/403 |
| 8,056,448 | B2 * | 11/2011 | Chen | 81/121.1 |

* cited by examiner

*Primary Examiner* — Hadi Shakeri
(74) *Attorney, Agent, or Firm* — Hovey Williams LLP

(57) ABSTRACT

An improved, high-efficiency wheel lug nut socket is provided for use in racing pits, in order to minimize the time required for race car wheel changeovers. The socket is designed with an inner operating surface including concave surfaces and intervening apex surfaces, dimensioned so as to permit a hexagonal lug nut to be received therein with full clearance between the inner operating surface and the lug nut outer surface. The socket is normally used with a conventional high-speed pneumatic automotive wrench.

7 Claims, 3 Drawing Sheets

HIGH-EFFICIENCY WHEEL LUG NUT SOCKET FOR USE IN AUTOMOTIVE RACING PITS

BACKGROUND OF THE INVENTION

1. Field of the Invention

The present invention is broadly concerned with high-efficiency wheel lug nut sockets for use in racing pits in order to materially decrease pit service times for the removal and attachment of racing car wheels. More particularly, the invention is concerned with such improved wheel lug nut sockets which are designed to facilitate very rapid attachment of the sockets over wheel lug nuts for attachment or removal thereof.

2. Description of the Prior Art

During automobile races of substantial duration, race car drivers must pull their vehicles into service pits for refueling and complete wheel changes by the pit crew. Speed is of course essential in these services, else the driver will lose valuable time and race position. The limiting factor in pit servicing times is typically that required for wheel changes. In conventional practice, high-speed pneumatic wrenches are employed, such as the Ingersoll Rand "Thunder Gun," which operates at a rotational speed of 10,000 rpm or greater. Tubular wheel lug nut sockets are secured to the wrenches, and are designed to mate with the wheel lug nuts.

During wheel removal, the pneumatic wrench is continually operating at high speed with the socket spinning counterclockwise, and the socket is successively applied to the wheel lug nuts for removal thereof. As the nuts are sequentially removed, the ejector spring of the socket ejects the nuts for disposal, thus clearing the socket for the next nut. After all five nuts for a given wheel are removed, the old wheel and tire are pulled from the drum studs, and a new wheel and tire are mounted on the studs. Typically, the lug nuts of the new wheel are initially adhesively applied to the outer surface of the wheel in registry with the stud openings, and once the wheel is preliminarily mounted, the wrench and socket, now spinning clockwise, are sequentially applied to the lug nuts in order to tighten the nuts on the studs to complete the wheel installation. As the socket is applied to each nut, the ejector spring is compressed within the socket.

The goal of every pit crew is to minimize pit service times. Inexperienced or sub-par crews are generally able to complete a service within 15-17 seconds. However, every crew seeks, in race car parlance, to "be in the twelves," meaning that a full tire and fuel service is completed within about 12-13 seconds. As can be appreciated, the time difference between the pit service of a slow crew versus a faster crew can be very significant, especially during races requiring multiple, full-service pit stops. In this regard, the limiting factor in low pit service times is the time required for wheel replacements.

Conventional wheel nut sockets are plagued by a number of problems. First, the old sockets exhibit a tendency to spark and "round" the wheel lug nuts, owing to the fact that it takes 5-8 revolutions of the socket to engage and "grab" a lug nut. Also, considerable hand pressure must be exerted on the wrench to ensure that the socket is properly seated on a lug nut. Conventional sockets typically wear out every 2-3 races, requiring replacement thereof. Furthermore, these conventional sockets typically have an enlarged lip adjacent the open operating end thereof, which can engage an adjacent nut as the socket is withdrawn.

There is accordingly a need in the art for improved wheel lug nut sockets for use in automotive racing contexts which permit removal and replacement of automotive tires in a minimum of time.

SUMMARY OF THE INVENTION

The present invention overcomes the problems outlined above and provides a wheel lug nut socket for use in racing pits which materially decreases wheel replacement times. Generally speaking, a socket in accordance with the invention comprises an elongated, tubular socket body presenting an open, lug nut-receiving operating end and an opposed tool connection end. The operating end has an inner operating surface configured to receive a hexagonal lug nut therein and comprises a plurality of concave surfaces in spaced relationship to each other with an apex surface between each pair of side-by-side concave surfaces. The lug nut has an outer surface comprising six wrench flat surfaces with an apex between each side-by-side pair of wrench flat surfaces. The inner operating surface of the socket is configured and dimensioned to permit the hexagonal lug nut to be received within the socket with full clearance between the inner operating surface and the lug nut outer surface; as or after the rotating socket is seated over the lug, the socket engages the lug nut flats in order to rapidly remove or attach a lug nut, depending upon the direction of socket rotation.

Normally, the operating surface of the socket comprises six side-by-side and identical concave surfaces with identical, substantially flattened apex surfaces between each side-by-side pair of concave surfaces.

Use of the improved sockets of the invention permits rapid placement of lug nuts in a racing pit environment, so that total pit service times are minimized.

DETAILED DESCRIPTION OF THE PREFERRED EMBODIMENT

Figure 1:
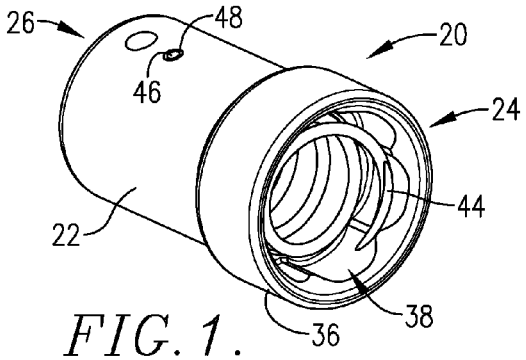
FIG. 1. PRIOR ART
FIG. 1 is a perspective view of a conventional prior art wheel lug nut socket, viewing the enlarged, operating end of the socket, and depicting the standard internal lug nut ejector spring within the socket.
Figure 7:
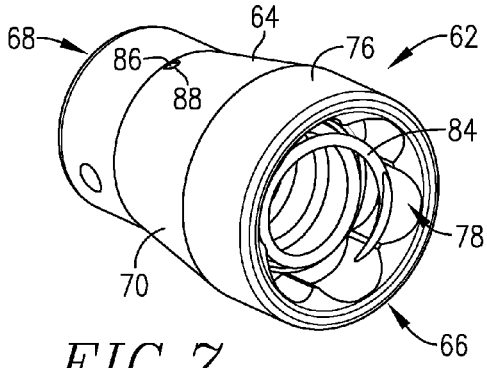
FIG. 7 is a perspective view similar to that of FIG. 1, illustrating the improved lug nut socket of the invention, and depicting the standard internal lug nut ejector spring within the socket.
Figure 2:
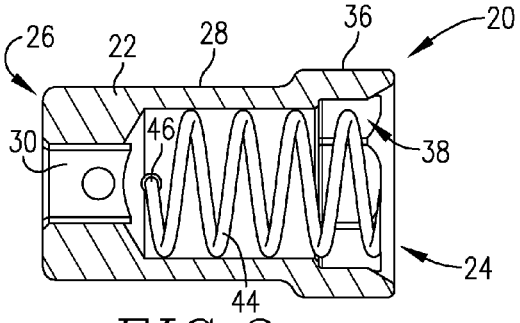
FIG. 2. PRIOR ART
FIG. 2 is a vertical sectional view of the prior art socket.
Figure 8:
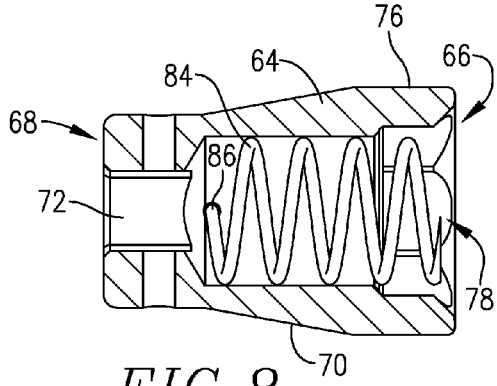
FIG. 8 is a vertical sectional view similar to that of FIG. 2, but depicting the improved lug nut socket of the invention.

The Prior Art Wheel Lug Nut Socket

Turning to FIGS. 1-6, a conventional wheel lug nut socket 20 is illustrated. The socket 20 includes an elongated, tubular metallic body 22 presenting an enlarged, open, operating end 24 and an opposed tool connection end 26, with a tubular section 28 between the ends 24, 26.

Figure 13:
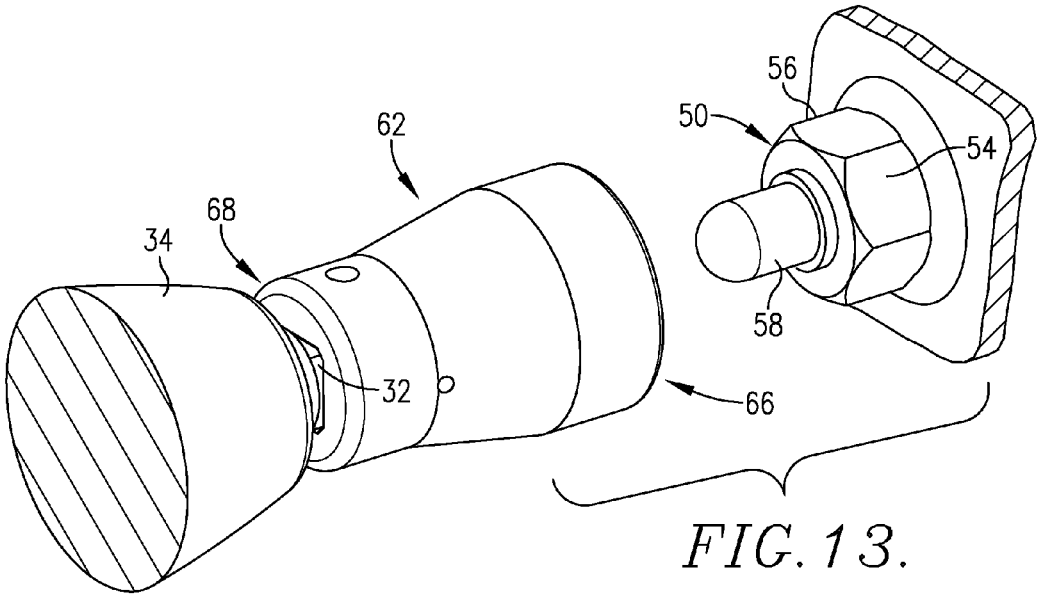
FIG. 13 is a fragmentary perspective view illustrating positioning of an impact wrench equipped with the improved lug nut socket of the invention, prior to placement over an installed lug nut.

The tool connection end 26 includes a substantially square opening 30 designed to receive the square coupler 32 of a standard pneumatic lug socket wrench 34, as illustrated in FIG. 13. The operating end 24 includes a radially enlarged, lug nut-receiving segment 36 having an internal operating surface 38. The surface 38 (see FIG. 5) presents six identical, circumferentially arranged concave surfaces 40, with an apex surface 42 between each adjacent pair of concave surfaces.

The tubular section 28 is designed to receive a compressible coil lug nut ejector spring 44; the inner end 46 of spring 44 is received within an opening 48 through the sidewall of section 28, in order to retain the spring 44 within the socket 20.

Figure 3:
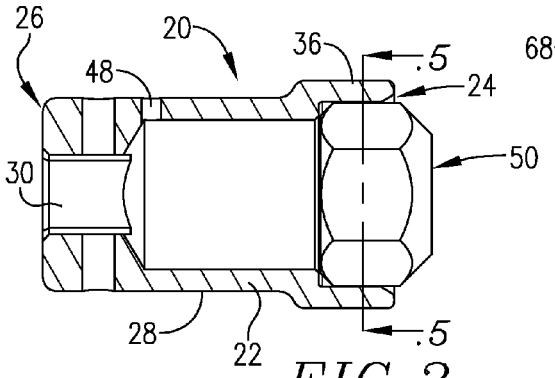
FIG. 3. PRIOR ART
FIG. 3 is a vertical sectional view similar to that of FIG. 2, but illustrating the socket without the presence of the ejector spring, and with a hexagonal lug nut received within the operating end of the socket.
Figure 5:
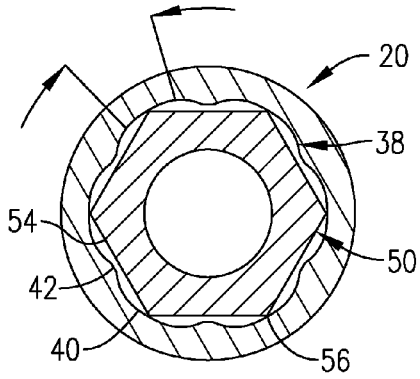
FIG. 5. PRIOR ART
FIG. 5 is a vertical sectional view taken along line 5-5 of FIG. 3.
Figure 6:
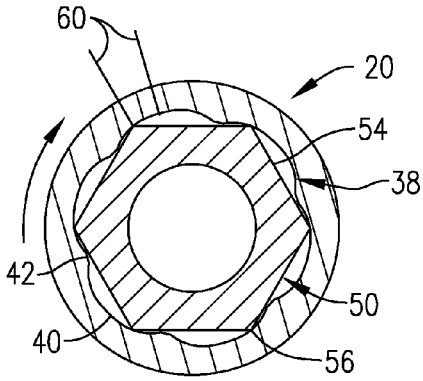
FIG. 6. PRIOR ART
FIG. 6 is a view similar to that of FIG. 5, but depicting the engagement between the socket and lug nut after initial rotation of the socket.

As illustrated in FIGS. 3 and 5-6, the segment 36 and operating surface 38 are configured and dimensioned to receive a conventional hexagonal wheel lug nut 50 within the segment 36, such that the inner operating surface 38 engages the nut 50. As depicted, the lug nut 50 has an outer surface 52 including six circumferentially arranged wrench flat surfaces 54 with a substantially pointed apex 56 between each adjacent pair of the flats 54. Specifically, it will be observed that the inner operating surface 38 is designed so that portions of the outer nut surface 52, namely the apices 56, initially engage corresponding portions of the operating surface 38, namely the concave surfaces 40, when the socket 20 is installed on a nut 50.

When a rotating socket 20 is installed as illustrated in FIG. 5 on a nut 50, the nut 50 is correspondingly rotated for removal from or attachment to a threaded wheel stud 58 secured to a drum (not shown). This socket rotation may be clockwise or counterclockwise for nut attachment or removal, as depicted by the directional arrows in FIG. 5. The socket 20 is conventionally mounted on a high-speed pneumatic wrench 34 (FIG. 13). FIG. 6 illustrates this operation during clockwise rotation of socket 20, where it will be seen that the apex surfaces 42 come into contact with the nut flats 54 to rotate the nut 50. It will further be seen that the nut apices 56 remain in contact with the concave surfaces 40 during socket rotation. The distance between the radial lines 60 in FIG. 6 illustrates the arc through which the socket 20 must travel between the initial installation position of FIG. 5 and the socket operating position of FIG. 6. Of course, the operation of socket 20 is identical when rotating in a counterclockwise direction.

As explained previously, the design of the conventional socket 20 unacceptably slows the removal and attachment of lug nuts onto the wheel studs 58. This is because time is required for the rotating socket to properly seat and assume its drive position over each of the lug nuts before the nut may be removed. Given that in a racing pit stop a total of twenty nuts 50 need to be removed, and 20 new nuts 50 need to be installed, it will be appreciated that these time-wasting socket installation deficiencies inherent in the design of the standard socket 20 represent a significant time loss to the pit crew.

The Wheel Lug Nut Socket of the Invention

The improved wheel lug nut socket 62 is illustrated in FIGS. 7-14, and broadly includes a substantially tubular, open-ended metallic body 64 presenting an enlarged, open operating end 66, an opposed tool connection end 68, with a tapered tubular section 70 between the ends 66, 68.

The tool connection end 68 includes a substantially square opening 72 designed to receive a square coupler 32 of a standard lug socket wrench 34, illustrated in FIG. 13. The operating end 66 includes a radially enlarged, lug nut-receiving segment 76 having an internal operating surface 78. The surface 78 (see FIG. 11) presents six identical, circumferentially arranged concave surfaces 80 with substantially flattened apex surfaces 82 between each adjacent pair of concave surfaces. The tubular section 70 is designed to receive a compressible coil lug nut ejector spring 84; inner end 86 of the spring 84 is received within the opening 88 through the sidewall of section 70, in order to retain the spring 84 within the socket 62.

Figure 9:
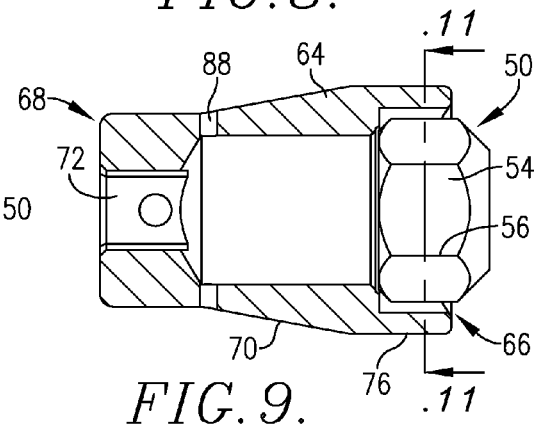
FIG. 9 is a view similar to that of FIG. 3, but illustrating the improved lug nut socket of the invention with the ejector spring removed and receiving a hexagonal lug nut.
Figure 4:
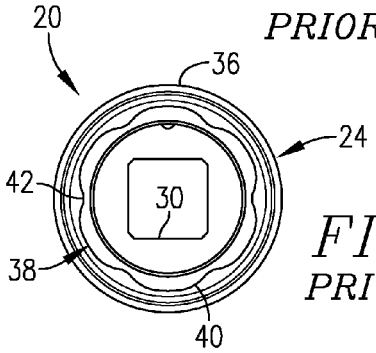
FIG. 4. PRIOR ART
FIG. 4 is a front elevational view of the prior art socket.
Figure 10:
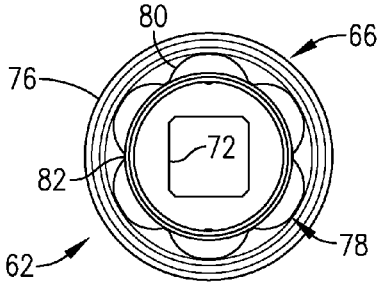
FIG. 10 is a front elevational view similar to that of FIG. 4, but depicting the improved lug nut socket of the invention.
Figure 11:
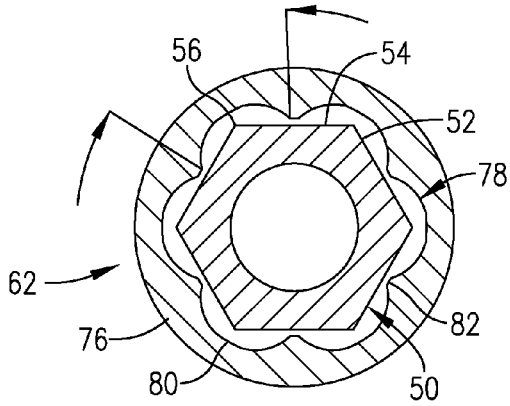
FIG. 11 is a vertical sectional view taken along the line 11-11 of FIG. 9, and illustrating the improved lug nut socket of the invention with a hexagonal lug nut seated within the socket.
Figure 12:
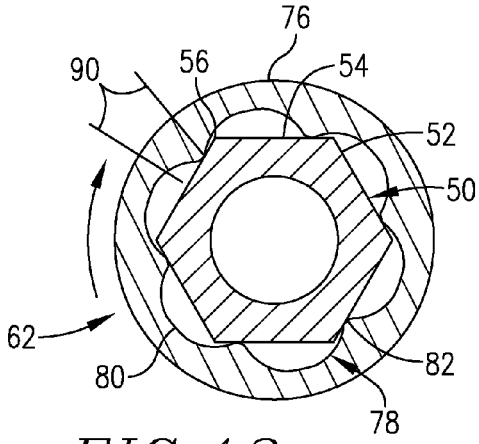
FIG. 12 is a view similar to that of FIG. 6, but depicting the engagement between the improved lug nut socket of the invention and the lug nut after initial rotation of the socket.

As illustrated in FIGS. 9 and 11-12, the segment 76 and operating surface 78 are configured and dimensioned to receive a conventional hexagonal wheel lug nut 50, previously described. However, and significantly different than the conventional socket 20, the operating surface 78 of socket 62 is configured and dimensioned so that the nut 50 may be fully received within the section 78 with full clearance between the operating surface 78 and the lug nut outer surface 52, i.e., so that the inner operating surface 78 may be located out of contact with the lug nut outer surface 52. It will be appreciated that, owing to the speed of rotation of the socket 62 during placement thereof over a lug nut 50, there may be contact between the surfaces 78 and 52 from the outset; nonetheless, the increased clearance provided between these surfaces facilitates rapid placement of the socket and consequent lug nut rotation.

When the socket 62 is installed on a nut 50, as illustrated in FIG. 11, the socket 62 is rotated so as to correspondingly rotate the nut 50 for removal from or attachment to a threaded wheel stud 58, as illustrated by the directional arrows in FIG. 5. FIG. 6 depicts rotation of the socket 62 in a clockwise direction, where it will be seen that the flattened apices 82 come into contact with adjacent nut flats 54, while the nut apices 56 are maintained in spaced relationship to the concave surfaces 80. The distance between the radial lines 90 in FIG. 6 illustrates the arc through which the socket 62 must travel between the full clearance position of FIG. 5 and the socket operating position of FIG. 6. Again, counterclockwise rotation of socket 62 is identical in operation.

Figure 14:
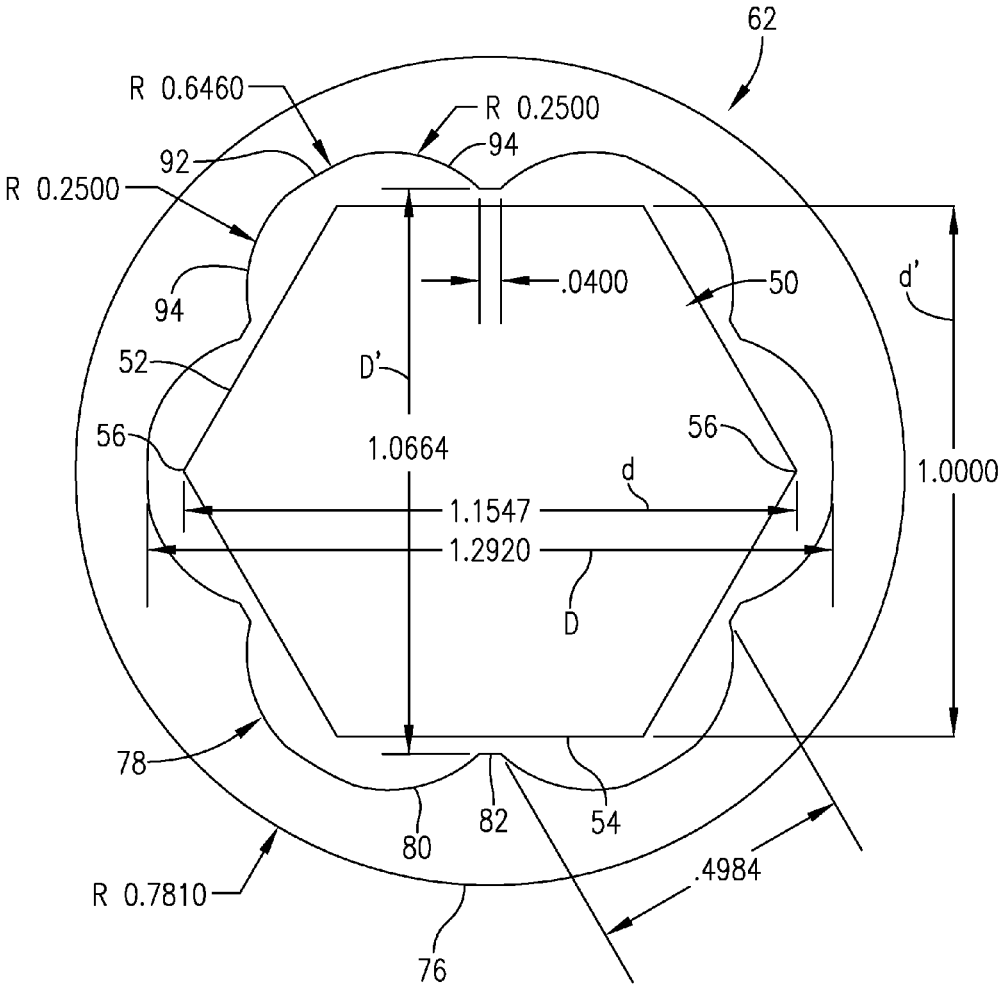
FIG. 14 is a greatly enlarged, schematic view similar to that of FIG. 11, and including the most preferred dimensions of the improved lug nut socket of the invention.

Attention is next directed to FIG. 14, which is a greatly enlarged schematic version of FIG. 11. As illustrated therein, the centers of opposed concave surfaces 80 are spaced apart a distance D, and the opposed apex surfaces 82 are spaced apart a distance D'. Correspondingly, the opposed nut apices 56 are spaced apart a distance d, and the opposed flat surfaces 54 of the nut 50 are spaced apart a distance d'. In accordance with preferred embodiments of the invention, the distance D is greater than the distance d; the distance D is preferably at least about 0.1 inches longer than the distance d, and more preferably from about 0.12-0.15 inches longer. Similarly, the distance D' is greater than the distance d'; preferably, the distance D' is at least about 0.04 inches longer greater than the distance d', more preferably from about 0.04-0.07 inches longer. As further depicted in FIG. 14, the flattened surfaces 82 should have a width of at least about 0.02 inches, more preferably from about 0.03 inches. Moreover, the distance between each adjacent pair of flattened surfaces 82 should be at least about 0.4 inches, more preferably from about 0.45-0.5 inches. Finally, it will be observed that each concave surface 80 has a large radius central portion 92 with smaller radius end sections 94 leading to the adjacent surfaces 82.

The configuration of the operating surface 78 relative to the nut 50 permits very rapid installation of the rotating socket 62 over a nut 50. That is to say, owing to the full clearance between the socket operating surface 78 and the nut outer surface 52, the pit crew members can more quickly make a complete wheel changeover.

The overall operation of lug nut removal or attachment using socket 62 is the same as with socket 20, i.e., the socket 62 is coupled with the wrench 34, and the wrench is operated to rapidly rotate the socket. The socket is then successively placed over the wheel lug nuts 50 for removal from or attachment thereof to the studs 58. In the case of nut removal, once the wrench 34 is removed from the studs 58, the ejector spring 84 serves to eject the removed nut 50 from the socket, so that the next nut may be removed. When a fresh wheel and tire are mounted onto a race car drum, the crew member places the socket over a pre-adhered nut 50 on the wheel, so as to compress the spring 84 and allow attachment of the nut. The significant difference in the operation of socket 62, as compared with that of the socket 20, chiefly resides in the ability to more rapidly and easily install the socket 62 over nuts 50.

Actual experience with the sockets 62 as compared with the conventional sockets 20 has demonstrated that pit times involving complete replacement of a race car's wheels and tires are substantially reduced, even for inexperienced pit crews. Indeed, sub-par crews performing a pit service using standard sockets 20 will commonly clock a pit time exceeding 15 seconds. However, these pit times can regularly be reduced by such crews to the 12-13 second time range using the improved sockets 62.

In greater detail, it has been found that the improved sockets of the invention will engage and "grab" a lug nut within 1-2 revolutions of the socket, and less hand pressure on the wrench is required. This decreases the tire change time by about 0.4 seconds per side, or almost one second per pit stop. A one-second advantage translates to approximately 275 feet at 180 mph on the track, meaning that a fast pit stop can put a racer ahead of the field. Given that a typical NASCAR CUP race will involve 15-20 pit stops, this advantage is quite considerable over the entire course of a race.

The tapered design of the socket of the invention permits the larger inside dimensions of the socket operating end, and also makes the socket smoother to handle by crew members. The lack of any peripheral lip adjacent the operating end of the socket also eliminates the problem of "grabbing" adjacent nuts during removal.

All of these factors contribute to the improved performance of the present sockets versus those of the prior art. Most important, the sockets hereof can turn a mediocre tire-change crew member into a superior member, while reducing pit times.

I claim:

1. A wheel lug nut socket comprising:

an elongated, tubular socket body presenting an open, lug nut-receiving operating end and an opposed tool connection end, said operating end having an inner operating surface configured to receive a hexagonal lug nut therein and comprising a plurality of concave surfaces in spaced relationship to each other with an apex surface between each pair of side-by-side concave surfaces, said lug nut having an outer surface comprising six wrench flat surfaces with an apex between each side-by-side pair of wrench flat surfaces, said inner operating surface being configured and dimensioned to permit said hexagonal lug nut to be received within the socket with full clearance between said inner operating surface and said lug nut outer surface, said inner operating surface engageable with said lug nut outer surface during axial rotation of the socket, said inner operating surface comprising six side-by-side concave surfaces with a substantially flattened apex surface between each pair of the side-by-side concave surfaces, the distance D between the centers of opposed concave surfaces being at least about 0.1 inches longer than the distance d between opposed apices of said lug nut, the distance D' between opposed apex surfaces being at least about 0.04 inches greater than the distance d' between opposed wrench flat surfaces.

2. The wheel lug nut socket of claim 1, the distance D being from about 0.12-0.15 inches longer than the distance d.

3. The wheel lug nut socket of claim 1, the distance D' being from about 0.05-0.07 inches greater than the distance d'.

4. The wheel lug nut socket of claim 1, each of said flattened apices having a width of at least about 0.02 inches.

5. The wheel lug nut socket of claim 4, said widths being from about 0.03-0.05 inches.

6. The wheel lug nut socket of claim 1, the distance between each adjacent pair of flattened apices being at least about 0.4 inches.

7. The wheel lug nut socket of claim 6, the distance between each adjacent pair of flattened apices being from about 0.45-0.5 inches.

* * * * *